US008387313B2

(12) United States Patent
Hamlin, III

(10) Patent No.: US 8,387,313 B2
(45) Date of Patent: Mar. 5, 2013

(54) STRETCHED CABLE MEMBRANE ATTACHMENT SYSTEM

(76) Inventor: Henry Lee Hamlin, III, Macon, GA (US)

( * ) Notice: Subject to any disclaimer, the term of this patent is extended or adjusted under 35 U.S.C. 154(b) by 0 days.

(21) Appl. No.: 12/378,325

(22) Filed: Feb. 13, 2009

(65) Prior Publication Data

US 2009/0307988 A1 Dec. 17, 2009

Related U.S. Application Data

(63) Continuation-in-part of application No. 12/214,070, filed on Jun. 16, 2008, now abandoned.

(60) Provisional application No. 60/934,747, filed on Jun. 15, 2007.

(51) Int. Cl.

| | |
|---|---|
| ***E04D 5/00*** | (2006.01) |
| ***E04B 7/00*** | (2006.01) |
| ***E04B 1/00*** | (2006.01) |
| ***E04B 5/00*** | (2006.01) |

(52) U.S. Cl. ..... 52/23; 52/5; 52/222; 52/410

(58) Field of Classification Search ..... 52/3–5, 52/23, 222, 408, 409, 410, 741.3, 741.4
See application file for complete search history.

(56) References Cited

U.S. PATENT DOCUMENTS

| | | | | |
|---|---|---|---|---|
| 1,871,101 | A * | 8/1932 | Waltz | 135/119 |
| 5,522,184 | A * | 6/1996 | Oviedo-Reyes | 52/23 |
| 5,623,788 | A * | 4/1997 | Bimberg et al. | 52/23 |
| 5,966,877 | A * | 10/1999 | Hawes | 52/63 |
| 2004/0045223 | A1 * | 3/2004 | Deskin | 52/3 |
| 2007/0193121 | A1 * | 8/2007 | Diaz et al. | 52/3 |

* cited by examiner

*Primary Examiner* — William Gilbert
(74) *Attorney, Agent, or Firm* — Brian D. Bellamy

(57) ABSTRACT

The system and method of securing a single ply membrane to a roof deck or structure described herein is of a system that utilizes sections of cable that are completely protected or surrounded by the single ply membrane. There may be a set of perimeter cables or interior cables that secure the membrane according to the needs of the building and the necessary specifications on the roof. The cables are secured at their endpoints and, possibly, additional fasteners may be provided along their lengths. Flashing of the cables provides that they be completely protected from the elements, as are most fasteners in flat or low slope roofing systems.

12 Claims, 6 Drawing Sheets

STRETCHED CABLE MEMBRANE ATTACHMENT SYSTEM

CROSS REFERENCE TO RELATED APPLICATIONS

This invention is based upon and claims the benefit of U.S. Provisional Application Ser. No. 60/934,747, filed the 15 Jun. 2007 and is also a continuation in part of the U.S. Non-Provisional application Ser. No. 12/214,070, filed the 16 Jun. 2008.

INTRODUCTION

The title of the invention set forth in this document is "Stretched Cable Membrane Attachment System." The inventor's name is Henry L. Hamlin III, residing in Macon, Georgia and with United States citizenship. The inventor's correspondence address is PO Box 7548, Macon, Ga. 31209.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APENDIX

Not applicable

BACKGROUND OF THE INVENTION

1. Field of the Invention

The present invention relates to a method and system of installing roofing or waterproofing membrane, particularly installation whereby the membrane is secured with a cable and related fasteners.

2. Background

A typical low slope roof consists of the following components, from bottom to top (not including structural components of the building): deck system, insulation, and a waterproof barrier. The perimeter of the roof may be flat, have a parapet wall, or a combination of both. In the main field of the roof, there can be any number of roof penetrations and other items, including such features as plumbing vent pipes, HVAC units on curbs or supports, expansion joints, conduit, or a wide variety of other items.

Singly ply membranes are rapidly becoming the most popular roofing system for buildings with low slope roofs. Single ply membranes include such materials as thermalplastics (TPO, PVC, CPE, among others) and rubber roof membrane (EPDM). These materials typically are packaged in roll form and are unrolled onto the roof during installation. The sides and ends of the rolls are overlapped and then joined via some form of adhesion (heat or chemical means are the most common) to form a larger, continuous sheet. The rest of installation depends on the means of waterproofing at through roof penetrations and other rooftop structures but also includes an especially important step—securing the roof to the building's structure.

There are 3 primary means of securing a roofing system to a building's structure: mechanical fastening, adhering, or ballasting. Mechanical fastening involves passing fasteners through the membrane and substrate then into the decking material. This method is most common for roofs that are easily screwed into, i.e. wood or metal decks. Adhering involves gluing the roof system to the decking and is most common for roofs where the decking is not easily mechanically fastened to, especially in the case of concrete decks. Ballasting involves placing a fairly large quantity of small rock or pebbles on the membrane's surface. This method of securing the roofing system to the building works great in situations where one might not want or be able to mechanically fasten or fully adhere the roof. Each of these methods secures the roof system to the deck and structure of the building and each one can be used in a wide variety of instances, depending on the particular building's needs.

The most common types of decking for low slope roofs are: metal, wood, and concrete. Metal decking is comprised of sheets of metal that have been bent into a specific pattern in order to better support the weight of the roof. Wood decking is typically either sheets or planks of wood. Concrete decking is typically fairly thick (over one or two inches in thickness) and is either poured in place or set in pre-fabricated pieces. Though all of these types of deck are capable of receiving mechanical fasteners, it is a very simple process in wood and metal decks, while it is more difficult and labor consuming in concrete decks. Fastening into wood or metal simply requires screwing or nailing into it. Fastening into concrete requires pre-drilling the hole and then inserting a separate fastening mechanism into or through the hole. This process which is much more labor intensive and time consuming when one considers the vast majority of fasteners that must be installed on a roof to properly secure it with necessary wind uplift ratings.

Fully adhering or ballasting the roof system both carry with them disadvantages as well. It is not always possible to fully adhere to a roof due to moisture content within an existing roof system (in the case of re-roofing over the existing roof) or even due to the fumes from the adhesives. Ballasting the roof involves a large quantity of the rock in order to provide sufficient downward force to resist wind uplift. This rock must be moved to the roof during installation, requiring many truckloads for larger roofs. Also, if the roof is leaking, the repair process is not nearly as straightforward as the roof is hidden underneath a thick layer of rock. Both of these methods are highly labor intensive and require other special details in order to complete the roofing system.

Oftentimes, regardless of the type of deck, fully adhering or ballasting the roof are both out of the question. If the deck does not easily receive mechanical fasteners, one would ideally like an option to still mechanically fasten but with a lesser number of fasteners. There have been previous inventions that have attempted to solve this problem. One of interest would be U.S. Pat. No. 7,028,438, which is a roofing system that utilizes hold down straps for insulation. In addition, others have used batten bars, which help to further secure the roofing membrane in locations linearly between the main fasteners. U.S. Pat. No. 6,764,260 uses this method. These prior methods fail to sufficiently improve the process of mechanically fastening a roof.

SUMMARY OF THE INVENTION

The goal of this invention is improve the efficiency of mechanically fastening single ply membrane roofing systems, as well as to improve wind uplift resistance and durability of the roof system in general. The Stretched Cable Membrane Attachment System is designed around the idea of using a cable to secure the roof membrane to the deck of the building. The cable would still require mechanical fastening but the frequency of the fasteners themselves would be drastically reduced due to the cable providing additional holding strength between them. In turn, the job would require less labor and time to be properly installed. In addition, the means of installing the cable would require the cable and its fasteners be secured underneath (and completely encased in some cases) a layer of membrane so as to prevent any possible leakage. Provisions are included for different methods to accomplish this.

DETAILED DESCRIPTION OF THE INVENTION

With different embodiments serving different purposes and applications, this invention will be presented first in its preferred embodiment then alternate installations will be presented. In addition, installations will not necessarily be limited to installing this system exactly as described. Those skilled in the art will be able to apply the methods to particular roofing situations while still holding to the spirit of the invention.

The Stretched Cable Membrane Attachment System, in its preferred embodiment, consists of the following major components: the sections of cable along with a means for termination 3, the single ply roofing membrane, a building that is in need of a roof, and fasteners for securing the cable and membrane. On a building on which the decking and substrate were already installed (substrate including all materials between the roofing membrane and the decking), one would begin by laying out the roofing membrane onto the surface of the roof in the necessary pattern. The perimeter cables 1 would be installed at the perimeter of the building or section being roofed. Then, the interior cables 2 would be installed in the main field 6 of the roof. The cable itself can be fabricated from a variety of materials with metal strands of wire being the preferred embodiment.

Figure 6:
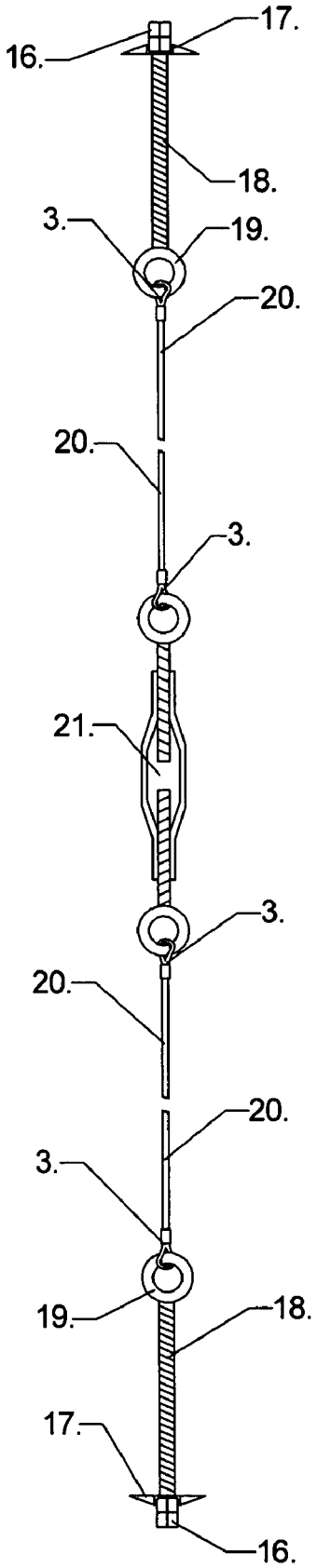
FIG. 6 is a close-up fragmented view of one possible embodiment of a particular section of cable (either 1. or 2.). At each end of the assembly, there is one type of fastening device, consisting of an a threaded shank (18.) and an eye (19.). On the distal end of the threaded shank (18.), there is a washer (17.) and then a nut (16.), which is threaded onto the shank (18.) to secure the washer (17.), which is used to secure the eyebolt in the fastening position. To each eye (19.), there is a section of cable (20.), shown fragmented in order to fit, that is connected. There is a turn buckle (21.) situated roughly in the center of the assembly.

The first item to present will be the methods of fastening the cable to the roof, the building, or both. If a building has parapet walls 5 of sufficient height raised around the perimeter of the roof, the end of each cable can be fastened to a wall on each end at an elevation close to the level of the roof. This could consist of any variety of fasteners 4, with one possibility being an eyebolt as shown in FIG. 6. The eyebolt could be placed such that the eye 19 is on the inside part of the wall 5 and the bolt's threaded shank 18 is on the outside part. The bolt would then be secured with a washer 17 and a nut 16 such that it was held firmly in place. At this point, the cable could be fastened to the eye 19, which typically consists of looping the end section 20 of the cable with a thimble in the loop and crimping the loop closed. The section of cable 1 or 2 would then be stretched in the direction of the next fastening point, at which point it would be secured the same method.

This is only one of many means of fastening the cable 1 or 2. Alternate ways would be to fasten the eyebolt or a similar fastener 15 through the substrate 7 and decking 8 or even anchor it into the decking. If a parapet wall 5 is not present or is not suitable to receive a viable fastener 4, one has the option of securing to the roofing decking 8. There are a wide variety of fasteners 15 that can be used, all of which achieve the same ultimate goal of securing the cable to the roof, but each of which works best for particular situations.

The perimeter cable system consists of multiple lengths of cable 1 which are comparable in lengths to each side of the building's perimeter. The cables 1 would ideally be fastened such that the each section of cable runs parallel to each side of the perimeter of the building. It would then typically be fastened at any inside and outside corners that are encountered along this perimeter.

At corners, each section of cable 1 could have its own fastener 4 or 15 at which it terminates 3 or the end points of two separate cables 1 could meet at the same fastening point.

The interior cable system consists of a plurality of cables 2 that are run across the interior of the main roof area 6 being roofed. The preferred method of running these cables 2 is to run them all parallel to one another and parallel with the direction of the slope of the roof, such that water drainage will not be impeded by the presence of the cable. This method can be altered depending on the exact roofing situation. In the preferred embodiment, each length of cable 2 will be fastened at or near to a perimeter edge of the building and then run in a direction perpendicular to the direction of the perimeter edge to which it is fastened. The interior cables 2 will be a regular distance apart, though this may vary depending on the quantity and positions of the roof penetrations and other features of the roofs surface. It may also be necessary that all cables 2 do not run from one perimeter edge to another. If there is a large feature in the path of the cable 2 that is run from one perimeter edge, the installer may choose to terminate the cable at the edge of the roof feature and then fasten it to the decking 8 at that location in the necessary manner. The distance apart for each section of cable 2 will be determined by the roof requirements, paying particular attention to wind uplift requirements, the type of membrane being used, and the method of fastening. A building with higher wind uplift requirements and a less rigorous method of fastening may require more interior cables 2 while one with low wind uplift requirements and a more rigorous method of fastening may require less interior cables.

There may also be interior cables 2 used around through roof penetrations to secure the roofing membrane at the penetration's base. In this case, it would depend on the wind uplift requirements on whether the cable was fastened to the decking 8. With less rigorous needs, one may be able to avoid fastening to the deck around roof penetrations. It is also possible that one may terminate around the roof penetration in standard ways without using any sort of cable, though that is typically going to rely on the wind uplift requirements for the building, as well as the contractor's skills and the type of building and decking. In many cases, adhesive may even be used around the perimeter of the roof penetration in place of the cable.

There are several methods of installing the cables 1 and 2 and incorporating it into the roof system. First, we will discuss the pre-fabricated cable encasement. In this case, each length of interior cable 2 will be pre-fabricated inside of a membrane encasement, preferably in advance and in a more controlled environment, though it can be done on site as well. This encasement consists of, from bottom to top: a lower strip of membrane 12, a length of cable 2, and an upper strip of membrane 13. The lower strip of membrane 12 would be made in lengths suitable for the end application on the roof as an interior field cable 2. The cable would be situated roughly in the center of the lower membrane strip's width and would be of slightly longer length than the lower strip such that it would have sufficient available length at its ends to properly loop the cable and terminate 3 it at the fastening points. The upper strip of membrane 13 would be of a length somewhat equal to the lower strip with a lesser width than the lower strip of membrane 12.

If using a membrane (such as thermalplastics) that is capable of being heat welded together, one could fabricate the cable encasement in the following manner, though there are a wide variety of ways to achieve the same goal. First, one would measure the length of interior cables 2 that are needed. The lower strip of membrane 12 would be cut so that it was of a length that would conform to the distance between the two fastening points, most likely equal to the distance between two walls 5 or two opposite perimeter edges of the building. The cable would then be placed on top of the lower strip of membrane 12 and situated such that it was roughly centered along the width and length of the lower strip of membrane. The upper strip of membrane 13 would be cut so that it was a length close to that of the lower strip. This upper strip of membrane 13 would be placed such that it was centered about the width of the lower strip of membrane 12 and cable and its endpoints matched closely to the endpoints of the lower strip of membrane. The width of both strips of membrane would be greater in dimension than the cable's diameter such that the cable could be encased within the two of them. The bottom surfaces of the edges of the upper strip that run along the longer ends would then be adhered via heat welding to the upper surfaces of the lower strip of membrane. The end result would be that the two strips of membrane would form an encasement around the cable, with the exception that the ends of the cable emerged from the open ends of the membrane encasement.

It is also possible to bypass the pre-fabrication step for this cable encasement and fabricate the encasement in the field or on the roof itself One can also make the encasement in a variety of ways, all of which will result in the cable being encased in membrane aside from the ends, which emerge from the distal open ends of the encasement. One alternate method would be to first heat weld a strip of membrane to the main roof membrane where the cable 1 or 2 will be installed. Then, the cable will be installed and a wider strip of membrane will be installed of the cable and the lower strip by heat welding the upper strip of membrane to the main roof membrane. Therefore, either the upper or lower strip of membrane can be larger. Differences also arise in the way that one installs the cable encasement to the main field roof membrane 11. It is preferable to have an additional layer of membrane between the cable and the main roof membrane 11. This prevents the cable from rubbing through the main roof membrane 11 and causing problems if there is too much movement. However, with the thickness of the membrane and the tightness of the cable, this extra precautionary layer of membrane is not always necessary. Alternately, one can install the cable directly over the main roof membrane 11 then install a strip of membrane over the cable by heat welding the sides of the strip on each side of the cable to the main roof membrane. This serves to secure the cable to the roof itself in the areas between where the fasteners secure the roof and cable to the decking 8, thereby providing reinforcing hold down strength throughout the entire length of the cable.

The preferred method of installation of the entire roof system would be to first lay the main roof membrane 11 on the substrate 7 and heat weld all seams (if not capable of being heat welded, seams can also be adhered or glued as needed). Any cutting for penetrations would also be done during this process. This will effectively form a single piece of membrane, loose laid on the roof substrate 7, and ready to be fastened and flashed. There should also be excess membrane 22 at the perimeters such that the cable can be encased and shielded from the elements. One can then begin installing the perimeter cables 1, situated such that the perimeter cable sits over but flush with the membrane along all perimeters of the building. This helps to ensure that the membrane will be held secure and close to the roof deck such that it secures the roof to the deck even between fasteners. Again, these fasteners may reside in parapet walls 5, outer walls, or within or through the decking 8 itself. These cables will then be fastened at the ends and tightened. It is also possible to install turn buckles 21 in the lengths of the cables to provide sufficient tension beyond what one is capable of with merely pulling the cable taut. It is also suggested that, if one is using a fastener like an eyebolt, that one secure these prior to installing the perimeter cable 1. Where the perimeter cable would intersect the interior cable eyebolt, one could pass the perimeter cable through the eye 19 of the eyebolt. This would permit the perimeter cables 1 to be at nearly the same elevation as the interior cables 2.

Once the perimeter cables 1 are fastened and securely in place, one can begin installation of the interior cables 2. Again, it is often more convenient to pre-install the fasteners, especially if one is intending to keep the cables at more exact distances apart. Once the fasteners are installed at the necessary distances apart, one will begin installing cable between each pair of fasteners. Ideally, these interior cables 2 should all be run parallel to one another but special situations may occur whereby cables may need to be crossed or at different angles.

The excess membrane 22 that overlaps the area of the roof should then be used to encase the perimeter cables 1 and protect them from the weather and elements. One would take the excess field membrane 22 where it reaches beyond the extent of the perimeter cable and fold it over the perimeter cable in the direction of the main roof membrane 11. Then, the excess membrane 22 would be welded or adhered to the main roof membrane, thus surrounding the cable in membrane except where the interior cables 2 are fastened to their fasteners. There will likely be places, such as where the interior cable fasteners are placed, where the membrane may have to be cut to allow for the excess membrane to fold over. Once this process is complete, standard wall or perimeter flashing methods can be done, typically whereby an additional layer of flashing membrane 10 can be taken and welded or adhered to the main roof membrane 11 further interior to the roof than where the excess membrane 22 is welded. The opposite end can then be secured to the wall 5 or outer perimeter of the building and terminated in the usual manner.

It is also possible to secure the cable within the membrane by placing the cable prior to heat welding the roof membrane seams. One could place the cable along one of the longer sides of a roll of membrane then fold that side over in the opposite direction such that it covers the cable, then heat weld it to itself such that the cable is encased in a tubular section of membrane. Then, one would place the next roll of roofing membrane such that it overlapped past the location of the heat weld 9 on the previous roll of membrane. The side of this next roll would then weld to the first roll of membrane such that the cable had even more protection inside of its first membrane encasement.

Figure 1:
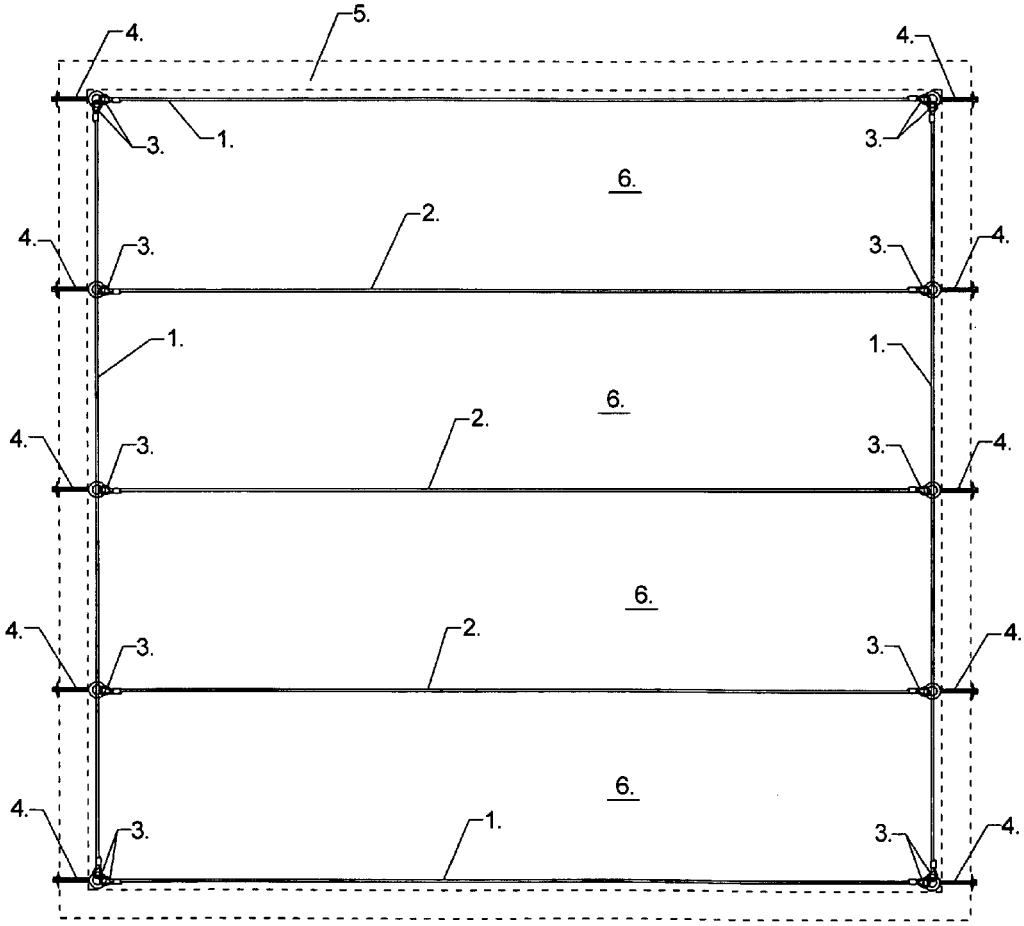
FIG. 1 is one embodiment of an overhead view of the surface of the roof with only the cable system showing (i.e. no membrane is depicted) in order to more clearly show the general layout. There is a plurality of wall fasteners (4.) fastened into opposite parapet walls (5.) and there are no wall fasteners (4.) in the parapet walls (5.) that are perpendicular to these. There are four perimeter cable sections (1.) that are connected to the wall fasteners (4.) at each of the four corners of the roof. There are three interior cables (2.) in the main roof area (6.) that are connected to wall fasteners (4.) on opposite parapet walls (5.). At each junction between cable section and wall fastener (4.), there is a cable termination (3.) where the endpoint of that particular section of cable is formed into a loop and crimped tightly to itself, forming a loop.
Figure 2:
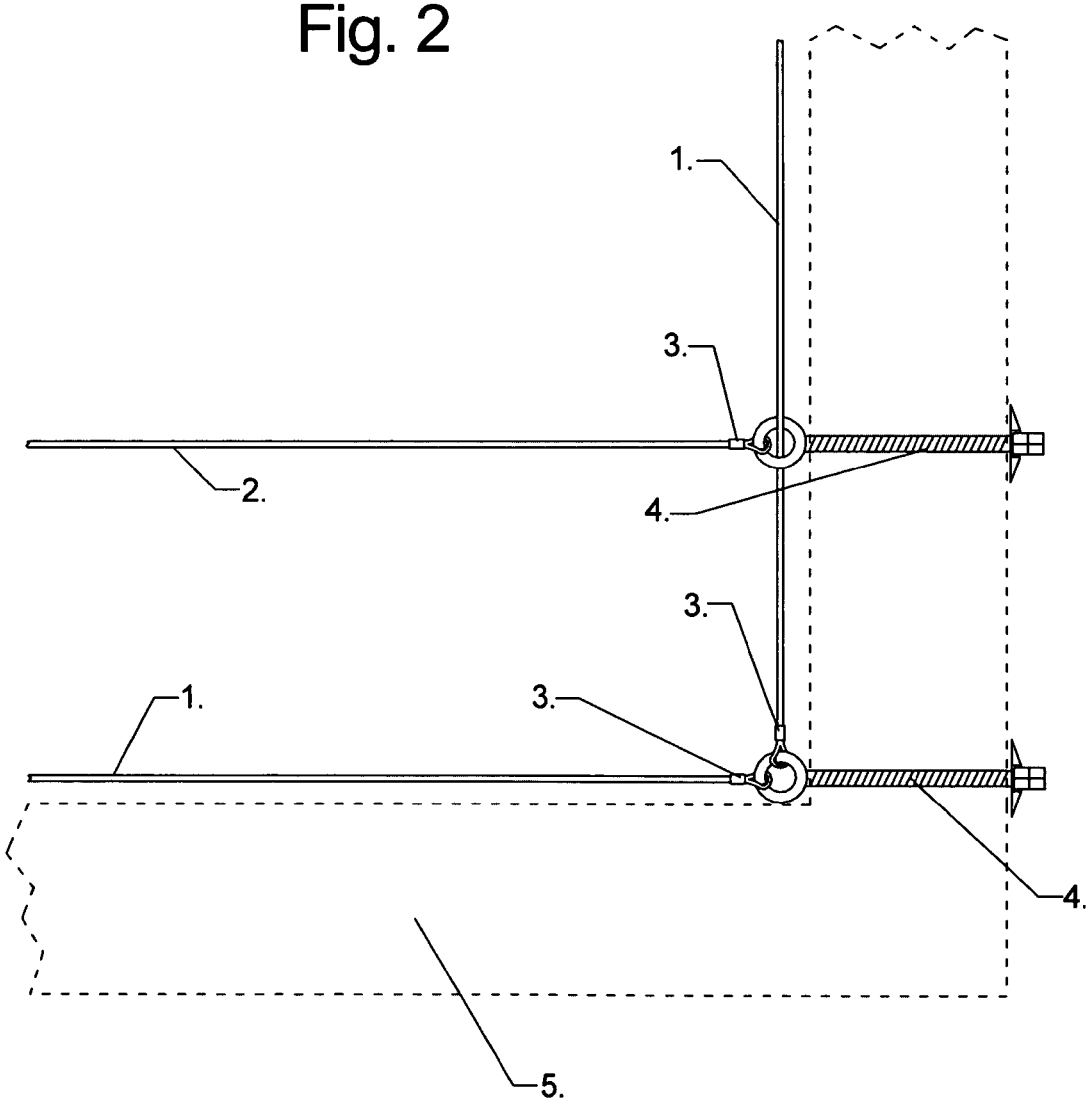
FIG. 2 is a closer version of the corner of the roof as shown in FIG. 1. There are two perimeter cable sections (1.) shown, joined in the corner via cable terminations (3.) at a wall fastener (4.) which is fastened through the parapet wall (5.). There is an additional wall fastener (4.), to which an interior cable (2.) is connected via a cable termination (3.).
Figure 3:
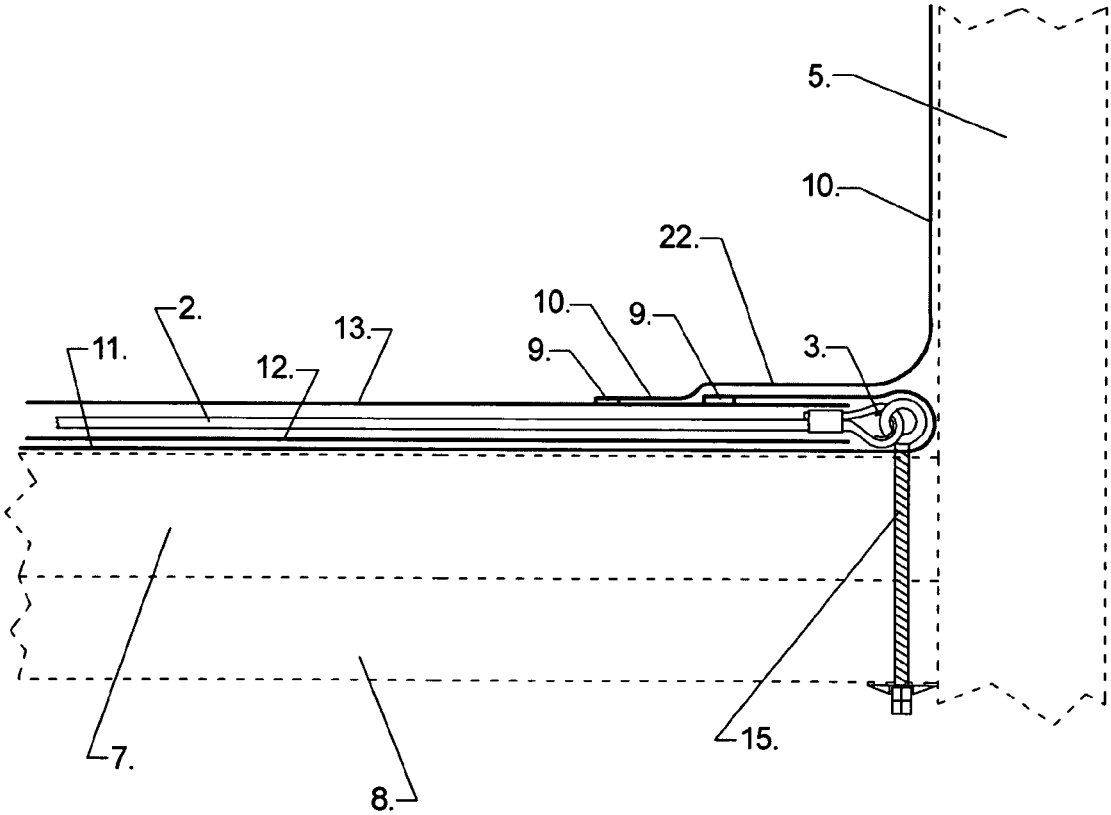
FIG. 3 is one embodiment of the invention showing a cutout view of an interior cable (2.) in its membrane encasement installed on a roof with a decking fastening device (15.) securing it. The cable (2.) is connected to the decking fastening device (15.) via the looped termination point (3.). The decking fastening device (15.) penetrates through the roof substrate (7.) and decking (8.). The field membrane (11.) is depicted beneath the membrane encasement assembly. The membrane encasement assembly consists of the lower strip of membrane (12.), which is beneath the cable (2.), and the upper strip of membrane (13.), which is situated over the cable (2.). The lower strip of membrane (12.) is heat welded or adhered to the field membrane (11.). The excess portion of the field membrane (22.) is then folded over the fastener (15.) and there is a heat weld (9.) between the excess membrane (22.) and the upper strip of the membrane encasement (13.). Then, in standard flashing methods, an addition layer of wall flashing membrane (10.) is adhered or fastened (method not depicted) to the parapet wall (5.) and then lays over the heat weld (9.) between the excess portion of the field membrane (22.) and the upper strip of the membrane encasement (13.). The wall flashing membrane (10.) is then welded to the upper strip of the membrane encasement (13.).
Figure 4:
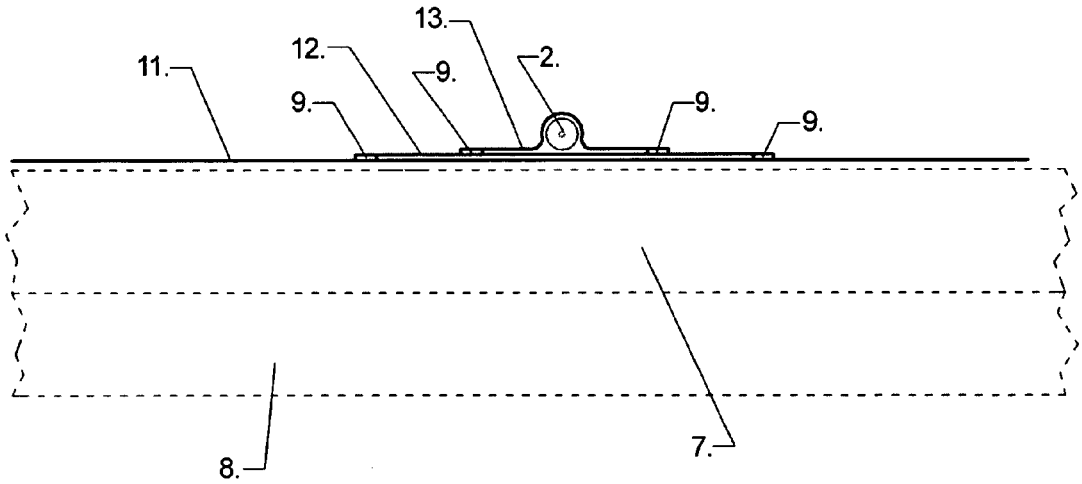
FIG. 4 is a cutout view of one possible embodiment of the membrane cable encasement. The roof substrate (7.) and decking (8.) are both shown with the main field membrane (11.) situated over them. The lower strip of the membrane encasement (12.) is then heat welded (9.) to the main field membrane (11.). The interior cable (2.) sits roughly midway on the lower strip of the membrane encasement (12.) and the upper strip of the membrane encasement (13.) is over the interior cable (2.) and is heat welded (9.) to the top surface of the lower strip of the membrane encasement (12.).
Figure 5:
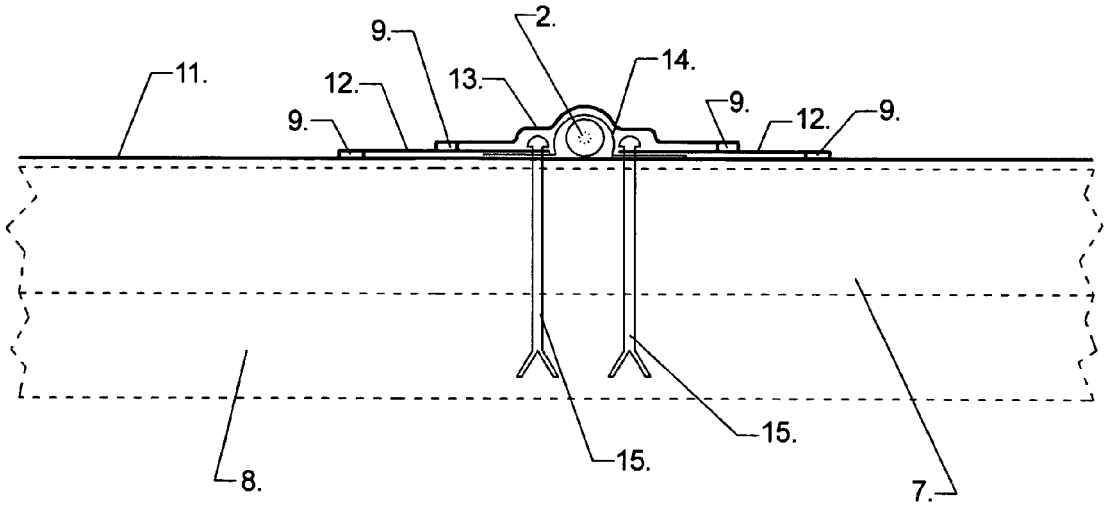
FIG. 5 is a cutout view of one possible embodiment of the membrane cable encasement with a cleat style fastener (14.) being used to secure the interior cable (2.) through the roof substrate (7.) and into the roof deck (8.) via one form of decking fastening devices (15.). The roof substrate (7.) and decking (8.) are both shown with the main field membrane (11.) situated over them. The lower strip of the membrane encasement (12.) is then heat welded (9.) to the main field membrane (11.). The interior cable (2.) sits roughly midway on the lower strip of the membrane encasement (12.) and the upper strip of the membrane encasement (13.) is over the interior cable (2.) and is heat welded (9.) to the top surface of the lower strip of the membrane encasement (12.). There is a hole cut in the lower strip of the membrane encasement (12.) such that the cleat style fastener (14.) can pass through it. However, the upper strip of the membrane encasement (13.) covers and waterproofs the penetrations.

For larger buildings or higher wind uplift ratings, it is often necessary to fasten the same pieces of cable in locations other than at the perimeters of the buildings, regardless of the cables running through the interior sections of the roof. In these situations, one would prefer to provide additional fasteners to the individual sections of the interior cables 2 or perimeter cables 1. This fastening would be done in methods appropriate to the substrate 7 and would be done in distances that would lead to sufficient hold down strength. In most buildings with concrete decking systems, the deck consists of a plurality of concrete panels, all of which are of similar sizes. One possible option for fastening in these types of decking systems would be to drill through the material which lies between the concrete panels, typically a filler material. One could then place an eyebolt through this hole with the eye above the roof and membrane and the bolt end protruding into the building itself. On the bolt end, one could place a washer that was larger than the gap between the concrete panels and then place a nut to secure the washer with sufficient tightness. This, again, is merely one method for fastening and many alternate methods, including a cleat style faster 14 as shown in FIG. 5, may be provided while still adhering to the spirit of the invention. In any of these cases, the fastener that is located within the length of the cable (i.e. not at the endpoints), should not in any case penetrate the upper strip of membrane which encases and waterproofs it. It is especially beneficial to not pre-fabricate the cable encasement in order to avoid this happening. Then, one is able to fasten the cable at some point along its length other than its endpoints and then the upper strip of membrane is welded over the cable and the lower strip, thus sealing the cable and any holes due to fastener penetration from the weather and elements.

Once the entire roof system is installed and secured with the cable system, standard flashing methods can be employed to completely waterproof the building. The end result should, in all cases, be that the cable is not exposed in any location to the elements. It should be encased on all sides by any of the following: roof substrate 7 or decking 8, parapet walls 5, roofing membrane, or other parts of the building's structure. The complete encasement of the cable is not only what brings strength to the system's wind uplift capabilities, but also what protects it and permits it to last long term under a high tension.

What is claimed is:

1. A roofing system comprising a roof of a building that includes a single ply membrane on a roof substrate of the roof of the building whereby a roof deck is provided on the building for attachment of the roof substrate, and a roofing material forming the roof on the building;

the roof substrate comprising materials situated between the roof deck and the roofing material;

the roofing material comprising the single ply membrane being on a surface of the roof substrate, a plurality of cable sections fastened at their respective endpoints to either the roof deck or the structure of the building over the membrane in order to secure the membrane to the deck, the cable sections being encased by a portion of the membrane or additional strips of membrane such that the sections of cable are completely protected from precipitation, and the cable sections are tightened in order to provide sufficient downward force to secure the membrane to the roof deck along the entire length of the cable;

the membrane covering the entire roof substrate to the perimeters of the roof deck is secured between the cable sections and the roof substrate; and flashing is applied about the perimeter of the membrane to aid in waterproofing the building.

2. The system of claim 1 whereby at least one of the cable sections is situated parallel and directly adjacent to perimeter edges of the roof deck and the endpoints of the respective at least one of the cable sections are fastened approximately at the inside and outside corners of the perimeter of the area on which the membrane is being installed.

3. The system of claim 1 whereby at least one of the cable sections is situated not directly parallel to perimeter edges of the roof deck, the endpoints of the respective at least one of the cable sections not directly parallel to the perimeter edges of the roof deck are fastened through the roof substrate and into or through the roof deck.

4. The system of claim 3 whereby said cable sections located not directly parallel to the perimeter edges are all situated within a pre-fabricated membrane encasement consisting of at least one piece of the membrane that is being installed on the surface of the roof substrate over the roof deck, such that the length of the cable section not directly parallel to the perimeter edges is entirely surrounded by strips of single ply membrane but the endpoints of the section of cable are exposed so that they may be fastened and later covered by said flashing, thereby completely encasing the section of cable.

5. The system of claim 3 whereby said cable sections located not directly parallel to the perimeter edges are all situated over the membrane with an additional layer of a lower strip of membrane welded between the section of cable and the membrane, such that the additional layer of the lower strip of membrane provides additional protection against rubbing from movement of the cable.

6. The system of claim 1 whereby at least one of the cable sections is situated parallel and directly adjacent to perimeter edges of the roof deck and the endpoints of the respective at least one of the cable sections is situated parallel and directly adjacent to the perimeter edges of the roof deck and fastened approximately at the inside and outside corners of the perimeter of the area on which the membrane is being installed, and at least one of the cable sections located not directly parallel to the perimeter edges of the roof deck, the endpoints of the respective cable section not directly parallel to the perimeter edges of the roof deck are fastened through the roof substrate and into or through the roof deck.

7. The system of claim 1 whereby at least one turnbuckle is situated linearly along the length of at least one of the cable sections, said turnbuckle is used to increase the tension of the cable section after it is fastened to the roof deck or building structure to secure the section of cable over the membrane.

8. The system of claim 1 whereby said cable sections are installed within seams of separate rolls of said single ply membrane such that a longer side of one roll of membrane overlaps a longer side of another roll of membrane and the sections of cable are situated between the two overlapping sides and the sides of the rolls of membrane are adhered or thermally joined such that the cable sections are each covered by a now joined membrane within a final seam.

9. The system of claim 1 whereby the cable sections are installed within seams of separate rolls of single ply membrane such that the cable sections are each set over one of the longer sides of the roll of single ply membrane and said longer side is folded over so that the cable section is rolled up into the membrane, and the top surface of the folded piece of membrane is adhered or thermally joined to the top surface of the remaining membrane at a distance proximate the cable section situated within it, such that the cable is radially enclosed within the membrane.

10. The system of claim 1 whereby the cable sections are preinstalled into a single longer side of a roll of membrane.

11. The system of claim 1 whereby the cable sections are also used to wrap around roof penetrations, with or without additional fastening, in order to secure the membrane tightly to the perimeter of the roof penetration, additionally providing that the sections of cable is wrapped in the single ply membrane during final flashing, such that it is protected from the weather.

12. The system of claim 1 whereby at least one said cable section further comprises at least one additional fastener linearly along the length of the cable section that provides additional holding strength to the roof deck and/or the structure of the building and such that the additional fastener is also protected from precipitation and the weather by covering it with the membrane.

* * * * *